US006854564B2

(12) United States Patent
Reuter et al.

(10) Patent No.: US 6,854,564 B2
(45) Date of Patent: Feb. 15, 2005

(54) ELEVATOR SYSTEM

(75) Inventors: Guenter Reuter, Filderstadt (DE); Wolfgang Meissner, Neuhausen (DE); Helmut Schlecker, Plochingen (DE); Walter Nuebling, Ostfildern (DE); Martin Kleine-Doepke, Filderstadt (DE)

(73) Assignee: ThyssenKrupp Elevator AG, Duesseldorf (DE)

( * ) Notice: Subject to any disclaimer, the term of this patent is extended or adjusted under 35 U.S.C. 154(b) by 208 days.

(21) Appl. No.: 10/270,017

(22) Filed: Oct. 11, 2002

(65) Prior Publication Data

US 2003/0075388 A1 Apr. 24, 2003

(30) Foreign Application Priority Data

Oct. 15, 2001 (EP) ..... 01124592

(51) Int. Cl.[7] ..... B66B 9/00; B66B 11/00

(52) U.S. Cl. ..... 187/249; 187/258; 187/406

(58) Field of Search ..... 187/249, 256, 187/257, 258, 405, 406

(56) References Cited

U.S. PATENT DOCUMENTS

| | | | | | |
|---|---|---|---|---|---|
| 1,218,617 | A | | 3/1917 | Baldwin | |
| 1,763,198 | A | * | 6/1930 | Sprague | 187/249 |
| 1,805,227 | A | * | 5/1931 | Rugg | 187/249 |
| 1,837,643 | A | * | 12/1931 | Anderson | 187/249 |
| 1,896,776 | A | * | 2/1933 | James | 187/249 |
| 1,911,834 | A | * | 5/1933 | Lindquist | 187/249 |
| 1,976,495 | A | * | 10/1934 | Halfvarson | 187/249 |
| 3,831,714 | A | | 8/1974 | Hedman et al. | |
| 5,419,414 | A | | 5/1995 | Sakita | |
| 5,526,901 | A | | 6/1996 | Salmon | |
| 5,699,879 | A | | 12/1997 | Sakita | |
| 5,816,368 | A | * | 10/1998 | Barrett et al. | 187/289 |

FOREIGN PATENT DOCUMENTS

| | | | | |
|---|---|---|---|---|
| JP | 04341479 A | * | 11/1992 | 187/249 |

OTHER PUBLICATIONS

*Patent Abstracts of Japan*, vol. 018, No. 112 (M–1565), Feb. 23, 1994, Abstract of Japanese Patent Publication No. 05306083, "Elevator Device", Nov. 19, 1993.

* cited by examiner

*Primary Examiner*—Eileen D. Lillis
*Assistant Examiner*—Thuy V. Tran
(74) *Attorney, Agent, or Firm*—Barry R. Lipsitz; Douglas M. McAllister

(57) ABSTRACT

An elevator system is provided for the transport of loads and/or persons in an elevator shaft. At least two elevator cars can be moved in the elevator shaft and are connected to a counterweight. A drive is associated with each car. At least one common track section and, in addition, separate track sections arranged next to one another are associated with at least two cars. The common track section and the separate track sections are arranged in sections along the elevator shaft. The cars can be moved not only in the same direction but also in directions opposite to one another.

21 Claims, 5 Drawing Sheets

ELEVATOR SYSTEM

The present disclosure relates to the subject matter disclosed in European application No. 01124592.5 of Oct. 15, 2001, which is incorporated herein by reference in its entirety and for all purposes.

BACKGROUND OF THE INVENTION

The invention relates to an elevator system for the transport of loads and/or persons in an elevator shaft with at least two elevator cars which can be moved in the elevator shaft and are connected to a counterweight via carrying means, wherein a drive is associated with each elevator car.

Elevator systems of this type are known from U.S. Pat. No. 1,837,643. In this case it is suggested that two cars be arranged in the elevator shaft one above the other. The two cars are coupled to a common counterweight via a carrying rope.

The use of several elevator cars in one elevator shaft is also described in U.S. Pat. No. 5,699,879. In this case it is suggested that a separate counterweight be associated with each car, wherein the counterweights are positioned one above the other.

In order to avoid the cars being limited in their movability, when several cars are arranged one above the other in one elevator shaft, due to the fact that all the floors can no longer be serviced by all the cars, the use of additional passing or storage areas, which are arranged at the upper and at the lower end of the elevator shaft, is suggested in U.S. Pat. No. 5,419,414. Passing areas of this type do, however, entail quite considerable construction costs.

It is suggested in the Japanese publication JP-A-4-341 479 that passing areas for the elevator cars be arranged in a central area of the elevator shaft. In this respect, two cars are provided in one elevator shaft and are coupled to one another like a pendulum in such a manner that upward travel of the one car requires downward travel of the other car. If one of the cars stops, this automatically leads to the other car also stopping. The transport capacity of such elevator systems is, therefore, limited.

It is the object of the present invention to develop an elevator system of the generic type further in such a manner that it can be produced inexpensively and has an improved transport capacity.

SUMMARY OF THE INVENTION

This object is accomplished in accordance with the invention, in an elevator system of the type specified at the outset, in that at least one common track section and, in addition, separate track sections arranged next to one another are associated with at least two elevator cars in sections along the elevator shaft, wherein the elevator cars can be moved not only in the same direction but also in directions opposite to one another.

The movement of the two cars along the elevator shaft is therefore partially along a common track section and partially along separate track sections arranged next to one another. This provides the possibility of using several cars in one elevator shaft, wherein each car can service, in particular, the end stops and the individual cars can travel independently of one another in the same direction or in directions opposite to one another. Depending on the area within a building, in which a particularly large number of passengers is to be expected, the separate track sections which are arranged next to one another can be arranged, for example, in a lower, a central and/or an upper area of the elevator shaft, wherein the separate track sections are connected to one another via common track sections.

In this respect, the separate tracks with the doors to the floors may, when seen from the position of the user, be arranged side by side or also behind one another and access can be from the front and/or from the rear side of the elevator shafts. The shaft doors can, of course, likewise be arranged to the side of the tracks so that access can be from both sides. When, in the area of the separate tracks, the distance of the tracks relative to one another is selected to be large enough, the doors to the floors can also be arranged between the tracks and the passengers can board between the elevator shafts.

Separate guide rails can be associated with the individual, respective elevator cars not only in the area of a common track section but also in the area of separate track sections. It may also be provided for the cars to be movable along commonly used guide rails in the area of a common track section. For this purpose, it is favorable to arrange deflection or change-over means in the area of transition between separate and common track sections so that the cars can be transferred to the respective guide rails.

Stops are preferably arranged not only in at least one common track section but also in separate track sections for the loading and unloading of the elevator cars. For example, it may be provided for at least one separate stop to be associated with each track section on each floor in the area of the separate track sections, wherein several shaft doors preferably arranged next to one another are provided on the respective floors so that these floors can be serviced by a plurality of cars.

In the area of transition from a common track section to separate track sections arranged next to one another shaft doors are preferably associated only with one track section. However, the shaft doors for one track section can also be arranged on the front side of the shaft and the shaft doors for another track section on the rear side of the shaft so that each floor can be serviced by each car.

It may be provided for the separate track sections to each be associated with at least one specific elevator car. The separate track sections can preferably each be entered by only one single car.

It is favorable when the separate track sections can each be entered by at least two elevator cars. This makes a greater flexibility of the elevator system possible, wherein it may, in particular, be provided for altogether more cars to be used than separate track sections provided. For example, it may be provided for the elevator system to have altogether three elevator cars available, wherein in at least one area of the elevator shaft two separate track sections arranged next to one another are provided and, in addition, at least one common track section is used.

As mentioned at the outset, the cars are coupled to a counterweight via the carrying means, for example, via carrying ropes consisting of steel or consisting of plastic or also via toothed or flat belts. In this respect, it may be provided for separate counterweights to be associated with the respective cars, wherein the counterweights can be moved along the elevator shaft either separately next to one another or at least in sections on a common counterweight track.

The drive associated with each car can, for example, drive the carrying means or a separate hoisting means as a driving wheel drive or it may, for example, drive the elevator car or the counterweight directly.

An elevator system, with which the counterweights are arranged one above the other and can be moved on a common counterweight track, can be produced particularly inexpensively.

In a preferred development of the inventive elevator system it is provided for two counterweight tracks to be arranged next to one another next to a common track section for the elevator cars. Such a configuration has the advantage that a separate counterweight can be associated with each elevator car, wherein the counterweights can be moved along separate tracks so that any interference of the movability of one of the counterweights does not impair the movability of the other counterweight.

In the case of particularly narrow space relations, it has proven to be advantageous when a counterweight track with two counterweights arranged one above the other is positioned next to a common track section for the elevator cars. The counterweights may, in this respect, be suspended with different suspension ratios.

In a preferred embodiment it is provided for the counterweights of two elevator cars to be connected to form a unit or to be designed as a unit and for the two cars to be connected to one another via a common line of carrying means, for example, a common rope line. The counterweights of the cars form a single counterweight unit which is coupled to the two cars.

It is preferably provided for the suspension ratios of two elevator cars and the associated counterweights to be different. For example, a suspension ratio of 1:1 can be provided for a first car, a suspension ratio of 2:1 for the second car and a suspension ratio of 4:1 for the common counterweight unit, wherein additional deflecting rollers for the carrying means are used. Such a suspension results in the counterweight unit traveling through a smaller area of the lifting height, through which the cars travel. In the example illustrated, the lifting height, through which the counterweight unit travels, is merely 75% of the lifting height, through which the cars travel.

In order to increase the transport capacity, it may be provided for the elevator system to comprise at least two common track sections arranged next to one another, wherein the counterweights are arranged between the common track sections. In this respect, it is favorable when the counterweights associated with the elevator cars of a common track section are respectively connected to one another to form a unit or are designed as a unit. Such an embodiment is characterized by at least two lines of track arranged next to one another, wherein each line of track has at least one common track section and, in addition, at least two separate track sections arranged next to one another. The counterweights are arranged between the two lines of track so that altogether a particularly space-saving configuration results.

It is of particular advantage when the elevator cars have different maximum speeds. In this respect, it is favorable when the faster car is arranged above the slower car in a common track section.

In a particularly simple development of the inventive elevator system from a constructional point of view, it is provided for a first elevator car to be movable in the elevator shaft only in a vertical direction and for the second elevator car to be movable to the side next to the first elevator car at least in the area of a stop. It is of advantage, in particular, in the case of such a configuration when the cars have different maximum speeds. For example, it may be provided for the faster car to be movable in the elevator shaft only in a vertical direction whereas the slower car can be moved to the side next to the elevator car at least in the area of a stop.

Particularly in cases, in which travel into a common track section and/or travel out of a common track section takes place over several floors, it may, however, also be provided for the slower elevator car to be movable in the elevator shaft only in a vertical direction whereas the faster elevator car can be moved to the side next to the slower elevator car at least in the area of a stop. The faster car can overcome the area of transition between the separate track section and the common track section in a shorter time. Preferably, no stops are associated with the faster car in the area of transition whereas the slower car which can be moved only in a vertical direction also has a stop on each floor in the area of transition between the separate track sections and a common track section.

As mentioned at the outset, the cars can be guided in the area of a common track section in such a manner that the cars either use the same guide rails or, however, that separate respective guide rails are provided. If the same guide rails are used, switch points or a deflection or change-over system can, for example, be used in the area of transition between the separate track sections and the common track section. It may be provided for at least one elevator car to be guided along additional guide rails when traveling into a common track section and/or when traveling out of a common track section.

When different guide rails are used for the upper and the lower elevator car guide means, the vertical alignment of the car can be achieved with guide means securely arranged on the car at distances of different sizes by means of correspondingly large distances between the guide rails.

In a particularly preferred development, with which the guide means for the upper and the lower elevator cars use the same guide rails, it is provided for the alignment of a car to be controlled by a guiding system when the car is traveling into a common track section and/or when the car is traveling out of a common track section. It can be ensured in a constructionally simple manner by means of the guiding system that the car essentially retains its vertical alignment also in the area of transition between a common track section and a separate track section.

For example, it may be provided for at least one elevator car to be arranged on a frame guided on guide rails, this frame being connected to the car via movable arms in order to align the car when traveling into and out of a common track section. The guiding system can likewise be arranged between the frame and the guide rails when the frame is securely connected to the car or the car is coupled directly to the guide rails by the guiding system without any frame.

The arm can, in this respect, be designed so as to be pivotable and pivot the elevator car to the side in relation to the associated guide rail during travel into and out of the common track section so that the car essentially retains its vertical alignment whereas the guide rail is aligned at an angle to the vertical in the area of transition between the common track section and the separate track section.

If the elevator cars can be moved in a common track section along common guide rails, it may be provided for the swinging out of the arm on one side of the car traveling out of the common track section to be coupled to a release of the guide means out of the guide rails on the other side of the car.

In a preferred embodiment it is provided for the distance between guide means and elevator car to be variable in an essentially horizontal direction by means of the guiding system at least in an upper or a lower area of the car.

The guiding system may be driven and/or controlled electrically. The guiding system can preferably be actuated mechanically. For example, it may be provided for the guiding system to comprise a piston-cylinder unit which can be acted upon with pressure hydraulically or pneumatically in the area of transition between a common track section and a separate track section. A position of the elevator car in relation to the starting or ending transverse acceleration which is comfortable for the user can, in particular, be achieved with an adjustable guiding system in the travel-in and travel-out areas of the area of transition since a controlled attenuation of the swinging of the car can be achieved.

The following description of preferred embodiments of the invention serves to explain the invention in greater detail in conjunction with the drawings.

BRIEF DESCRIPTION OF THE DRAWINGS

FIGS. 1 to 7 illustrate, in a considerably schematized form, a first embodiment of an inventive elevator system which is designated, altogether, with the reference numeral 10. The elevator system is built into an elevator shaft 12 with a shaft base 13, a shaft ceiling 14 as well as shaft side walls 15 and 16 and a shaft rear wall 17 and a shaft front wall 18.

Figure 4:
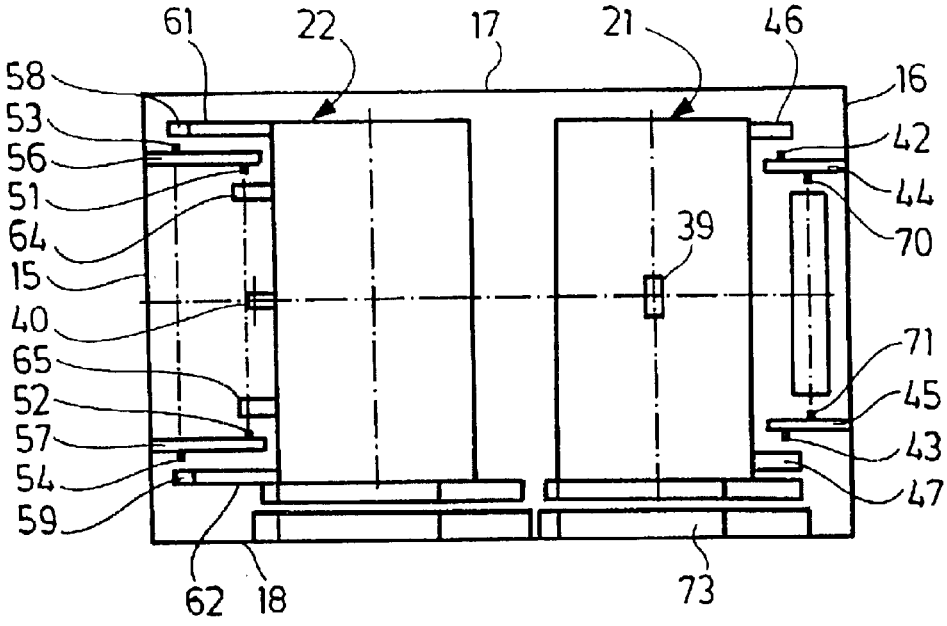
FIG. 4: shows a sectional view along line 4—4 in FIG. 1 with elevator cars arranged next to one another in separate track sections.

The elevator system 10 comprises two elevator cars 21, 22 which can be moved along the elevator shaft 12. The movement of the cars 21, 22 takes place along a common track section a in an upper area of the elevator shaft 12, in a lower area of the elevator shaft separate track sections b arranged next to one another are provided. If the two cars 21 and 22 are traveling through the common track section a, they are arranged one above the other. In the separate track sections, the cars 21 and 22 can, on the other hand, be arranged next to one another, as is apparent, in particular, from FIGS. 1 and 4. The common track section a is separated from the separate track sections b by an area of transition c. While the first car 21 can be moved along the entire elevator shaft 12 only in a vertical direction, the direction of travel of the second car 22 extends at an angle to the vertical in the area of transition c. The direction of travel of the second car 22 is shown by a double-headed arrow 24 in the area of transition c.

Figure 2:
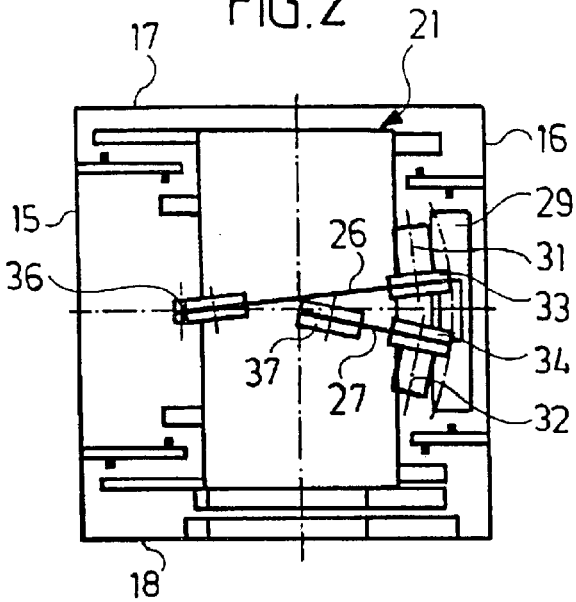
FIG. 2: shows a plan view of the elevator system according to FIG. 1 with elevator cars arranged one above the other in a common track section.
Figure 3:
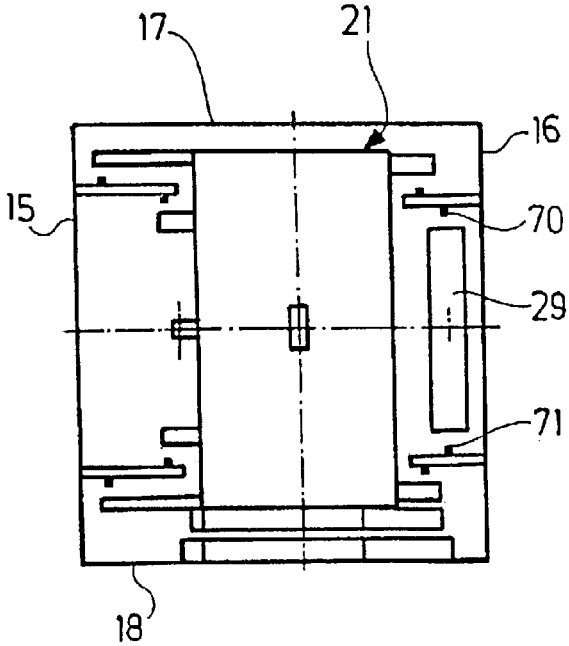
FIG. 3: shows a sectional view along line 3—3 in FIG. 1 with elevator cars arranged one above the other in a common track section.

The cars 21 and 22 are coupled to a common counterweight 29 via carrying ropes 26 and 27, respectively, wherein the carrying ropes 26 and 27 are connected to form a common rope in the area of the counterweight. A separate drive 31 or 32 is held in the area of the shaft ceiling 14 for the purpose of driving the respective cars 21 and 22. The drives 31 and 32 each comprise a driving wheel 33 and 34, respectively, via which the carrying ropes 26 and 27, respectively, are guided. This is apparent from FIG. 2. Deflecting rollers 36 and 37 are held for rotation in the area of the shaft ceiling 14 for the purpose of guiding the carrying ropes 26 and 27, respectively.

For the purpose of securing the carrying rope 26, the first car 21 comprises a carrying rope suspension means 39 which is aligned centrally in relation to its base surface, a corresponding carrying rope suspension means 40 is held laterally on the second car 22. As a result, it is ensured that the movement of the first car 21 in the common track section a is not hindered by the carrying rope 26 associated with the second car 22. Alternatively, a lateral arrangement of the carrying rope suspension means 39 could also be used for the first car 21 or a diagonal suspension with a double rope, whereby an altogether central suspension can again be achieved.

Figure 6:
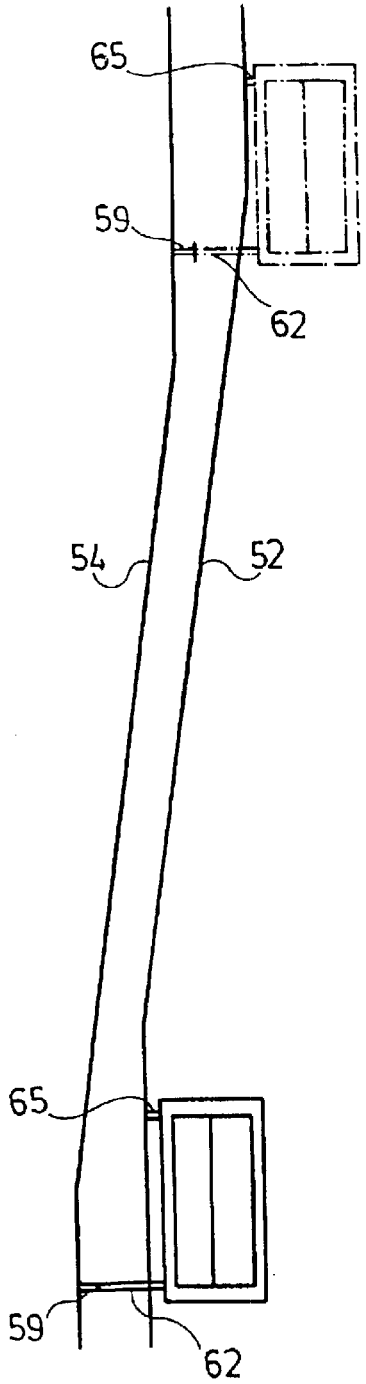
FIG. 6: shows a schematic illustration of the guidance of an elevator car movable at an angle to the vertical in an area of transition.

For the purpose of guiding the first car 21 in a vertical direction along the elevator shaft 12, two guide rails 42, 43, which are each T-shaped in cross section, are held on the shaft side wall 16 by means of rail supports 44 and 45, respectively. The first car 21 has guide means 46, 47 which are associated with the guide rails 42 and 43, respectively, in a manner known per se and, therefore, illustrated in the drawings only in a very simplified manner, these guide means each engaging around a guide rail 42 and 43, respectively (not illustrated). For the purpose of guiding the second car 22 along the elevator shaft 12, altogether 4 guide rails 51, 52, 53, 54 are used which are each of a T-shaped design and have associated guide means of the second car 22 engaging around them. The guide rails 51 to 54 are held on rail supports 56 and 57 which are secured to the shaft side wall 15. In this respect, the guide rails 51 and 52 are arranged at a greater distance in relation to the shaft side wall 15 than the guide rails 53 and 54. As is apparent, in particular, from FIG. 6, the guide means 58, 59 coupled to the guide rails 53 and 54 are fixed to a lower area of the second car 22 via arms 61 and 62, respectively, which are of a rigid design and aligned horizontally while the guide means 64 and 65 associated with the guide rails 51 and 52, respectively, are held on an upper area of the second car 22 at only a short distance. The guidance of the second car 22 via two pairs of guide rails, which are arranged at different distances in relation to the shaft side wall 15 and serve to guide the car 22 in an upper area and a lower area, respectively, makes it possible, as shown in FIG. 6, to align the second car 22 essentially in a vertical direction also when traveling through the area of transition c even though the direction of travel 24 of the second car 22 in this area extends at an angle to the vertical in accordance with the path followed by the guide rails 52 and 54 in FIG. 6.

Figure 7:
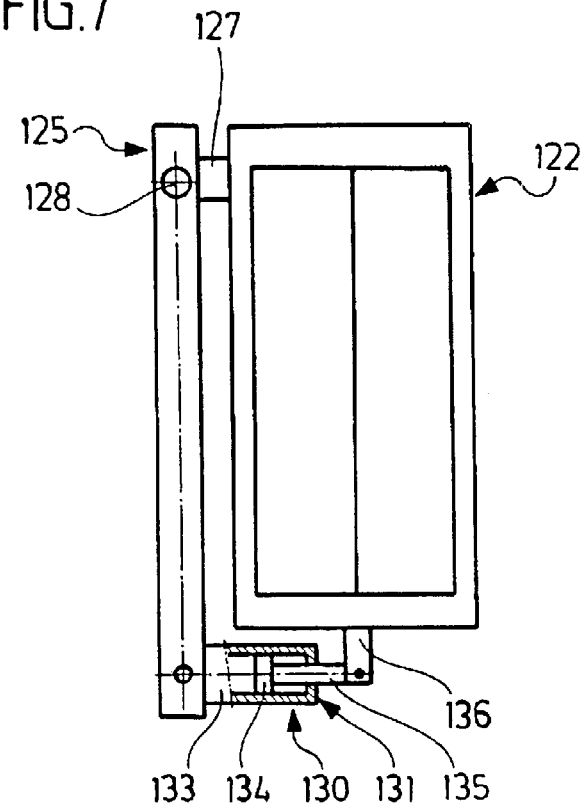
FIG. 7: shows an alternative design of the elevator car according to FIG. 6.

An alternative configuration of the second car 22 is illustrated in FIG. 7 and is designated altogether with the reference numeral 122. The car 122 is held for movement on a safety or catch frame 125 which is guided, on the other hand, on a pair of guide rails in a customary manner and not, therefore, illustrated in the drawings. The car 122 is held on the safety frame 125 at its upper area via a rigid arm 127 which is articulatedly connected to the safety frame 125 so as to be pivotable about a horizontal pivot axis 128 aligned parallel to the shaft side wall 15. For the purpose of holding the car 122 in its lower area on the safety frame 125, a guiding system 130 with a piston-cylinder unit 131 is used, wherein a cylinder 133 is articulatedly connected to the safety frame 125. A piston 134 is held for displacement in the cylinder 133 and a piston rod 135 projecting beyond the cylinder 133 is fixed on the piston, the free end of the piston rod being articulatedly connected to a pivot arm 136 rigidly connected to the car 122.

If the second car 122 travels through the area of transition c with a direction of travel 24 aligned at an angle to the vertical, it can be pivoted about the pivot axis 128 relative to the safety frame 125 with the aid of the guiding system 130 so that it essentially retains its vertical alignment in the area between the common track section a and the separate track sections b, as well.

Figure 5:
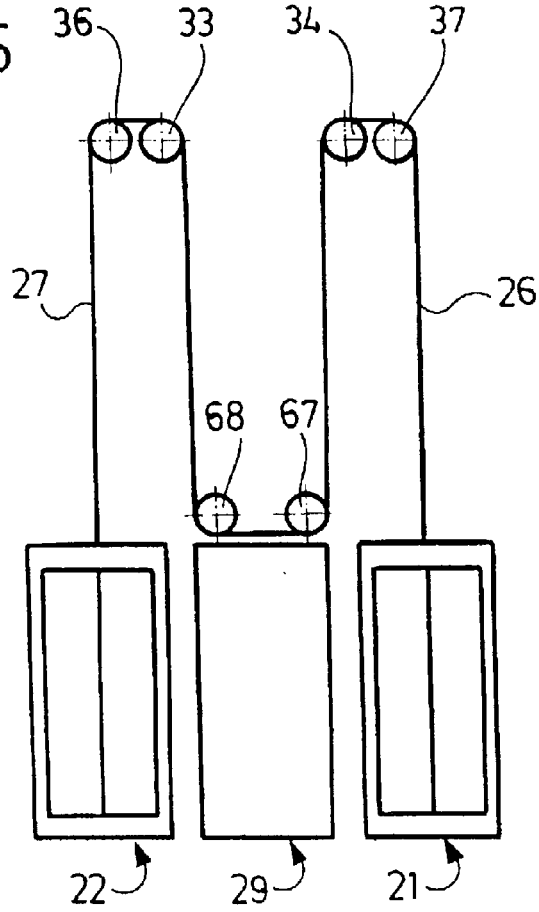
FIG. 5: shows a schematic illustration of the coupling of the elevator cars to a common counterweight.

As already mentioned, a common counterweight 29 is associated with the two elevator cars 21 and 22. The suspension of the cars 21, 22 and the counterweight 29 is illustrated in FIG. 5. In this respect, the two cars 21 and 22 are arranged to the side next to the counterweight 29 to achieve better clarity. The carrying ropes 26 and 27 form a common rope line which connects the cars 21 and 22 and the counterweight 29 to one another. In this respect, the two cars 21 and 22 can be moved independently of one another via the driving wheels 33 and 34, wherein the counterweight 29 performs a corresponding balancing movement. As is apparent from FIG. 5, the rope line connecting the two cars 21 and 22 and the counterweight 29 to one another is guided in such a manner that the carrying rope is guided, proceeding from the first car 21, first of all over the deflecting roller 37 and the driving wheel 34, subsequently the carrying rope is guided over deflecting rollers 67 and 68 held for rotation on the counterweight 29 to the driving wheel 33, from which the carrying rope is guided over the deflecting roller 36 to the second car 22.

For the purpose of guiding the counterweight 29, guide rails 70 and 71 are held on the rail supports 44 and 45, are likewise of a T-shaped design and have guide means engaging around them which are known per se, not illustrated in the drawings and are connected to the counterweight 29.

Figure 1:
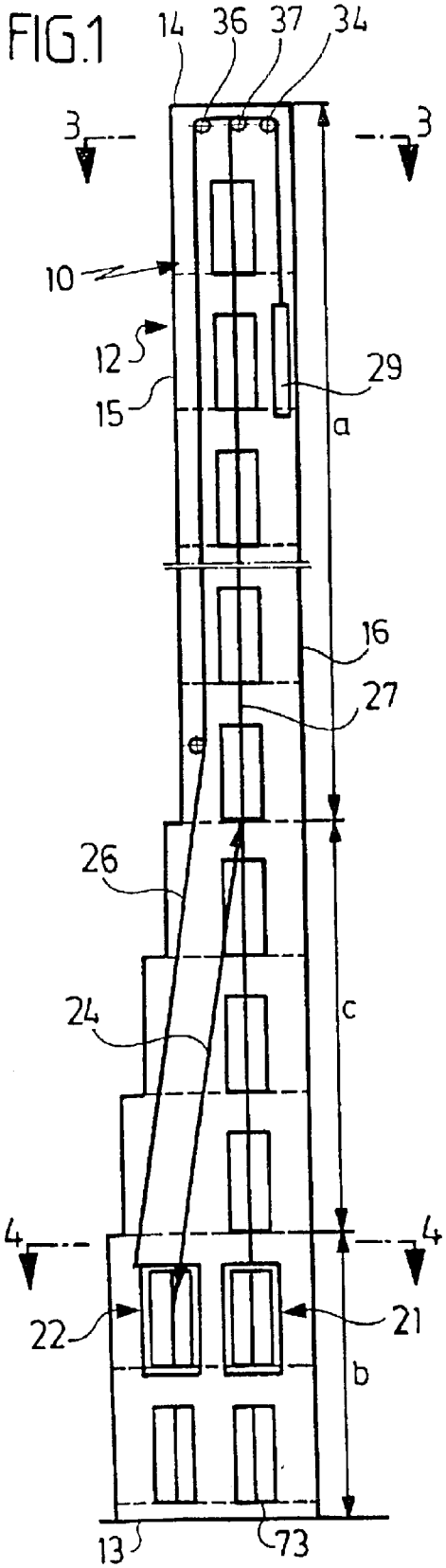
FIG. 1: shows a schematic longitudinal sectional view of a first embodiment of an elevator system according to the present invention.

In the case of the elevator system 10 illustrated in FIG. 1, a shaft door 73 is associated on each floor with the first car 21 which can be moved in a vertical direction and so all the floors of the building can be serviced by means of the first car 21.

In contrast hereto, no shaft doors are associated with the second car 22 in the area of transition c and so the second car 22 cannot service any floors in the area between the common track section a and the separate track sections b. The second car 22 has, however, a higher maximum speed than the first car 21 and so the second car 22 can travel through the area of transition c in a relatively short time while the individual floors can be serviced in this area of transition c by the relatively slow car 21.

Figure 8:
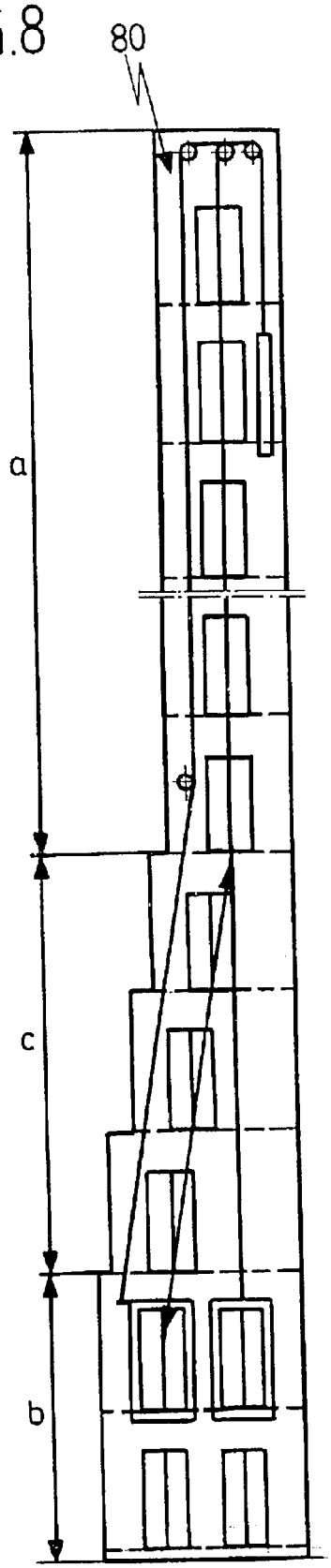
FIG. 8: shows a schematic longitudinal sectional view of a second embodiment of an elevator system according to the present invention.

In FIG. 8, an alternative embodiment of an elevator system is illustrated which is designated, altogether, with the reference numeral 80. This differs from the elevator system 10 explained in the above with reference to FIGS. 1 to 7 only in that respective shaft doors are associated with the second car 22 within the area of transition c and so the second car 22 can also service the respective floors in the area of transition c whereas no shaft doors are provided for the first car 21 in the area of transition c. Alternatively, doors can be arranged for one car within the area of transition c on the front side of the shaft and doors can be arranged for another car in the area of transition c on the rear side of the shaft.

In the embodiments according to FIG. 1 and FIG. 8, separate track sections, in which the cars 21 and 22 can be arranged next to one another, are provided only in the lower area of the elevator shaft 12. Such a configuration of the elevator system is particularly suitable for buildings which have a very high turnover of passengers, above all, in a lower area. A cafeteria which has a large number of visitors may, for example, be provided in these lower floor areas whereas the floors located higher are used by a smaller number of visitors.

Figure 9:
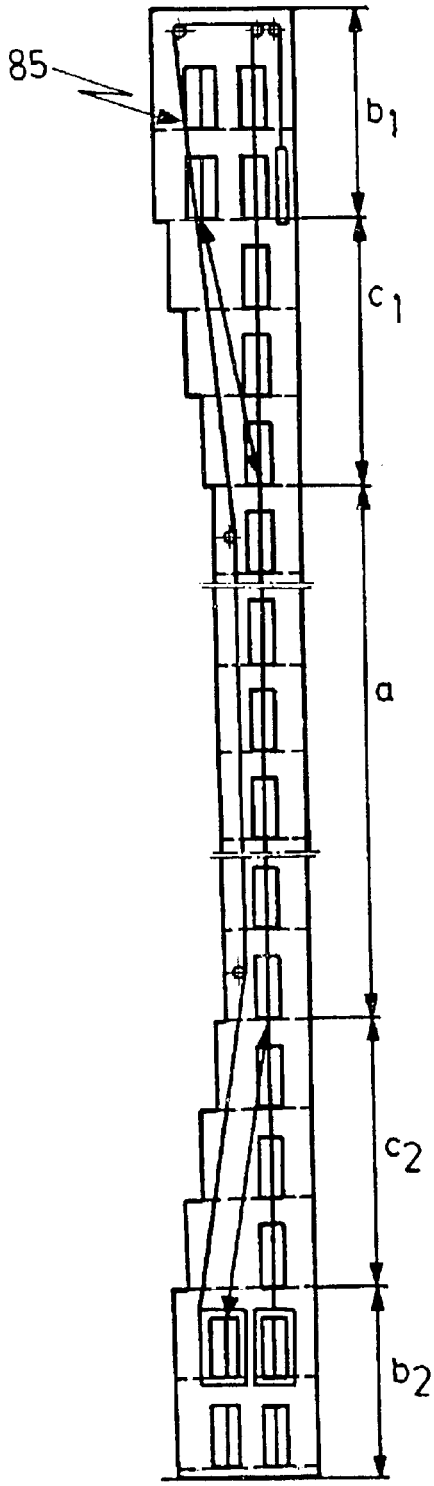
FIG. 9: shows a schematic longitudinal sectional view of a third embodiment of an elevator system according to the present invention.

However, it may also be provided for a large number of visitors to be expected not only in a lower building area but also in an upper building area and so it is of advantage when separate track sections are provided not only in the lower area but also in the upper area of an elevator shaft. An elevator system with a configuration of this type is illustrated in FIG. 9 and is designated, altogether, with the reference numeral 85. It is characterized in that separate track sections b1 and b2, respectively, which are each connected via an area of transition c1 and c2, respectively, to a common track section a, are arranged not only above but also below the common track section a which is centrally located. In the separate track sections b1 and b2, the cars 21 and 22 can be positioned next to one another in order to make access to these floor areas possible for as many passengers as possible within as short a time as possible.

Figure 10:
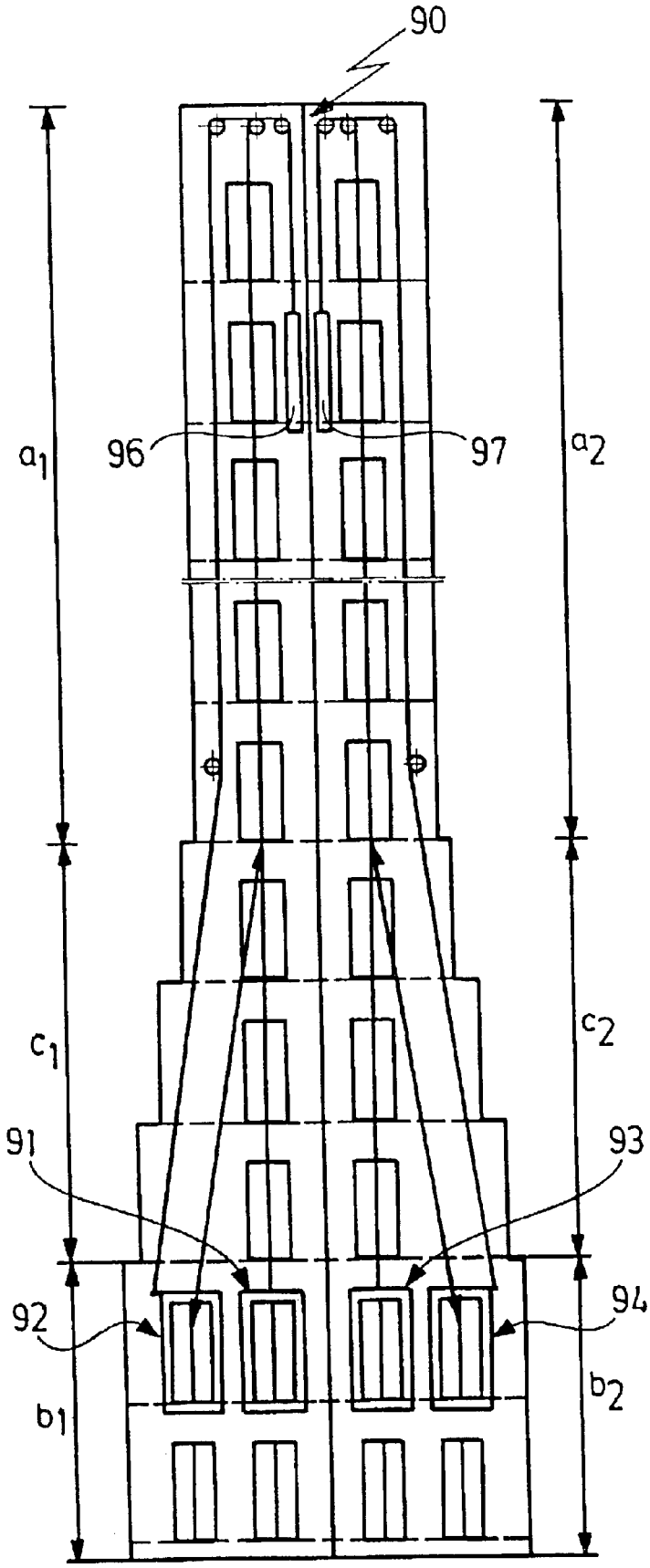
FIG. 10: shows a schematic longitudinal sectional view of a fourth embodiment of an elevator system according to the present invention.

A further, alternative elevator system is illustrated in FIG. 10 and is designated, altogether, with the reference numeral 90. This differs from the elevator system 10 explained in the above with reference to FIGS. 1 to 7 in that altogether four elevator cars 91, 92, 93 and 94 are used, with which separate respective track sections b1 and b2 are associated in a lower area of the elevator system 90, while in an upper area of the elevator system 90 two common track sections a1 and a2 are provided next to one another, in each of which two cars 91, 92 and 93, 94, respectively, which are arranged one above the other can be moved. A common counterweight 96 and 97 is associated with each two cars 91, 92 and 93, 94, respectively. The counterweights 96, 97 can be moved between the two vertical tracks and they can, as shown, be arranged next to one another but they can also be arranged behind one another in order to reduce the width.

What is claimed is:

1. Elevator system for the transport of loads and/or persons in an elevator shaft with at least two elevator cars movable in the elevator shaft, said elevator cars being connected to a counterweight via carrying means, wherein:

a drive is associated with each elevator car, one or more common track sections and, in addition, separate track sections arranged next to one another are associated with at least two of said elevator cars in sections along the elevator shaft, and said at least two elevator cars are movable in the same and opposite directions.

2. Elevator system as defined in claim 1, wherein said at least two elevator cars are guided on guide rails, wherein the same guide rails are associated with the elevator cars in an area of at least one of said common track sections.

3. Elevator system as defined in claim 1, wherein said at least two elevator cars are guided on guide rails, wherein separate guide rails are associated with the respective elevator cars in an area of at least one of said common track sections.

4. Elevator system as defined in claim 1, wherein stops for loading and unloading are arranged in at least one of said common track sections and in separate track sections.

5. Elevator system as defined in claim 1, wherein the separate track sections are each associated with at least one specific elevator car.

6. Elevator system as defined in claim 1, wherein the separate track sections are each adapted to be entered by at least two elevator cars.

7. Elevator system as defined in claim 1, wherein the counterweight is configured as separate counterweights associated with the respective elevator cars, wherein the counterweights are adapted to be moved on a common counterweight track at least in sections.

8. Elevator system as defined in claim 1, further comprising:

at least two counterweight tracks, said at least two counterweight tracks being arranged next to one another, wherein said at least two counterweight tracks are arranged next to a common track section for the elevator cars.

9. Elevator system as defined in claim 1, further comprising:

a counterweight track including at least two counterweights arranged one above the other, said counterweight track being arranged next to at least one of said common track sections for the elevator cars.

10. Elevator system as defined in claim 1, wherein the counterweights of said at least two elevator cars are connected to one another as a unit and wherein the two elevator cars are connected to one another via a common line of carrying means.

11. Elevator system as defined in claim 1, wherein suspension ratios of each of the at least two elevator cars and the associated counterweights are different.

12. Elevator system as defined in claim 1, wherein the elevator system comprises at least two common track sections arranged next to one another, wherein counterweights are arranged between the common track sections.

13. Elevator system as defined in claim 1, wherein said at least two elevator cars have different maximum speeds.

14. Elevator system as defined in claim 1, wherein a first elevator car is movable in the elevator shaft only in a vertical direction and wherein a second elevator car is movable to the side next to the first elevator car at least in the area of a stop.

15. Elevator system as defined in claim 1, wherein at least one elevator car is guided along additional guide rails during at least one of when traveling into a common track section and when traveling out of a common track section.

16. Elevator system as defined in claim 1, wherein at least one of traveling of the elevator car into a common track section and traveling of the elevator car out of a common track section is made possible by at least one of (i) a deflection system, (ii) a change-over system, and (iii) switch points.

17. Elevator system as defined in claim 1, wherein alignment of at least one of said at least two elevator cars is controlled by a guiding system during at least one of when the elevator car is traveling into a common track section and when the elevator car is traveling out of a common track section.

18. Elevator system as defined in claim 1, wherein at least one of said at least two elevator cars is held on a frame guided on guide rails, said frame being connected to the elevator car via movable arms in order to align the elevator car during at least one of when traveling into a common track section and when traveling out of a common track section.

19. Elevator system as defined in claim 17, wherein the distance between a guide means and said at least one elevator car is variable in an essentially horizontal direction by means of the guiding system in at least one of an upper area of the elevator car and a lower area of the elevator car.

20. Elevator system as defined in claim 1, wherein upper and lower guide means of an elevator car use one of the same guide rails and different guide rails.

21. Elevator system as defined in claim 20, wherein the upper and the lower guide means are held at different distances in relation to the elevator car.

* * * * *